US012398929B2

(12) United States Patent
Snider et al.

(10) Patent No.: US 12,398,929 B2
(45) Date of Patent: Aug. 26, 2025

(54) REVERSIBLE VALVE FOR HVAC SYSTEM

(71) Applicant: JOHNSON CONTROLS LIGHT COMMERCIAL IP GMBH, Neuhausen am Rheinfall (CH)

(72) Inventors: Ryan L. Snider, York, PA (US); Nicholas P. Mislak, Bel Air, MD (US); Karla D. Alvarez Cavazos, York, PA (US)

(73) Assignee: JOHNSON CONTROLS LIGHT COMMERCIAL IP GMBH, Neuhausen am Rheinfall (CH)

( * ) Notice: Subject to any disclaimer, the term of this patent is extended or adjusted under 35 U.S.C. 154(b) by 0 days.

(21) Appl. No.: 18/608,635

(22) Filed: Mar. 18, 2024

(65) Prior Publication Data

US 2024/0219077 A1 Jul. 4, 2024

Related U.S. Application Data

(63) Continuation of application No. 16/591,412, filed on Oct. 2, 2019, now Pat. No. 11,933,523.

(Continued)

(51) Int. Cl.
*F25B 13/00* (2006.01)
*F24F 3/153* (2006.01)

(Continued)

(52) U.S. Cl.
CPC ..... *F25B 13/00* (2013.01); *F24F 3/153* (2013.01); *F25B 41/20* (2021.01); *F25B 41/26* (2021.01); *F25B 2313/0276* (2013.01); *F25B 2313/0292* (2013.01); *F28F 9/22* (2013.01); *F28F 2250/102* (2013.01)

(58) Field of Classification Search
CPC ..... F24F 3/153; F25B 13/00; F25B 29/003; F25B 41/20; F25B 41/26; F25B 2313/0276; F25B 2313/0292
See application file for complete search history.

(56) References Cited

U.S. PATENT DOCUMENTS 7,191,604 B1 * 3/2007 Wiggs ..... F24F 3/153 62/89
7,275,384 B2 * 10/2007 Taras ..... F24F 3/153 62/159

(Continued)

FOREIGN PATENT DOCUMENTS

CN 107702370 A 2/2018
CN 107869855 A * 4/2018 ..... F25B 13/00

OTHER PUBLICATIONS

Machine Translation of CN107869855 (Year: 2025).*

*Primary Examiner* — Eric S Ruppert
*Assistant Examiner* — Hans R Weiland
(74) *Attorney, Agent, or Firm* — Fletcher Yoder, P.C.

(57) ABSTRACT

A heating, ventilation, and/or air conditioning (HVAC) system includes a reversible valve having an outlet configured to direct refrigerant to a reheat heat exchanger of the HVAC system. The reversible valve is further configured to be in a first configuration to direct the refrigerant through a refrigerant circuit in a first flow direction in a heating mode of the HVAC system and to be in a second configuration to direct the refrigerant through the refrigerant circuit in a second flow direction in a cooling mode of the HVAC system.

20 Claims, 10 Drawing Sheets

Related U.S. Application Data

(60) Provisional application No. 62/852,883, filed on May 24, 2019.

(51) Int. Cl.

| | |
|---|---|
| ***F25B 41/20*** | (2021.01) |
| ***F25B 41/26*** | (2021.01) |
| *F28F 9/22* | (2006.01) |

(56) References Cited

U.S. PATENT DOCUMENTS

| | | | | |
|---|---|---|---|---|
| 7,290,399 | B2 * | 11/2007 | Taras | F24F 3/153 62/93 |
| 7,770,405 | B1 * | 8/2010 | Dillon | F24F 3/153 62/93 |
| 7,975,495 | B2 | 7/2011 | Voorhis et al. | |
| 10,066,860 | B2 | 9/2018 | Downie et al. | |
| 10,234,149 | B2 | 3/2019 | Alford | |
| 2016/0273815 | A1 | 9/2016 | Downie et al. | |
| 2018/0003400 | A1 * | 1/2018 | Alford | F24F 3/153 |
| 2019/0178509 | A1 * | 6/2019 | Taras | F24F 3/153 |
| 2019/0203981 | A1 | 7/2019 | Akaiwa et al. | |
| 2019/0264932 | A1 * | 8/2019 | Shi | F24F 3/153 |
| 2019/0368754 | A1 * | 12/2019 | Blanton | F24F 3/153 |

* cited by examiner

REVERSIBLE VALVE FOR HVAC SYSTEM

CROSS REFERENCE TO RELATED APPLICATIONS

This application is a continuation application of U.S. patent application Ser. No. 16/591,412, entitled "REVERSIBLE VALVE FOR HVAC SYSTEM," filed Oct. 2, 2019, which claims priority from and the benefit of U.S. Provisional Application No. 62/852,883, entitled "REVERSIBLE VALVE FOR HVAC SYSTEM," filed May 24, 2019, each of which is hereby incorporated by reference in its entirety for all purposes.

BACKGROUND

This section is intended to introduce the reader to various aspects of art that may be related to various aspects of the present disclosure, and are described below. This discussion is believed to be helpful in providing the reader with background information to facilitate a better understanding of the various aspects of the present disclosure. Accordingly, it should be understood that these statements are to be read in this light, and not as admissions of prior art.

Heating, ventilation, and air conditioning (HVAC) systems are utilized in residential, commercial, and industrial environments to control environmental properties, such as temperature and humidity, for occupants of the respective environments. An HVAC system may control the environmental properties through control of an air flow delivered to the environment. For example, the HVAC system may place the air flow in a heat exchange relationship with a refrigerant of a vapor compression circuit to condition the air flow. In some embodiments, the vapor compression circuit may include a reheat heat exchanger that is used to control a moisture content of the air flow to achieve a target humidity of the air flow. The HVAC system may also include a supplemental heat source may be used to heat the air flow. However, including the supplemental heat source may increase a cost associated with manufacturing and/or operating the HVAC system. In alternative embodiments, the vapor compression circuit may be configured to operate in a cooling mode to cool the air flow and a heating mode to heat the air flow. However, such embodiments may not have a reheat heat exchanger and, as a result, may have a limited capability of controlling the moisture content of the air flow.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, heating, ventilation, and/or air conditioning (HVAC) system configured to condition an air flow includes a reversible valve that includes a first port, wherein the reversible valve is configured to be in a first configuration to direct refrigerant through a refrigerant circuit of the HVAC system in a first flow direction in a heating mode of the HVAC system and to be in a second configuration to direct the refrigerant through the refrigerant circuit in a second flow direction in a cooling mode of the HVAC system. In addition, the HVAC system includes a reheat heat exchanger configured to transfer heat from the refrigerant to the air flow in the heating mode and in the cooling mode, wherein the reversible valve is configured to discharge the refrigerant to the reheat heat exchanger via the first port in the heating mode and in the cooling mode.

In another embodiment, a heating, ventilation, and/or air conditioning (HVAC) system includes a compressor including a compressor discharge and a reheat heat exchanger configured to transfer heat from refrigerant to an air flow directed through the HVAC system in a heating mode of the HVAC system and in a cooling mode of the HVAC system, wherein the reheat heat exchanger is configured to receive the air flow from an additional heat exchanger of the HVAC system. The HVAC system also includes a reversing valve comprising an inlet configured to receive the refrigerant from the compressor discharge, a first port configured to discharge the refrigerant to the reheat heat exchanger in the heating mode and in the cooling mode, and a second port configured to discharge the refrigerant to the additional heat exchanger in the heating mode and to receive the refrigerant from the additional heat exchanger in the cooling mode.

In another embodiment, a heat pump configured to operate in a heating mode and in a cooling mode includes a reheat heat exchanger configured to transfer heat from refrigerant of the heat pump to an air flow supplied to a space within a building in the heating mode and in the cooling mode. In addition, the heat pump includes a first heat exchanger configured to transfer heat between refrigerant of the heat pump and the air flow supplied to the space within the building, a reversible valve having an inlet configured to receive pressurized refrigerant from a compressor of the heat pump, wherein the reversible valve is configured to be in a first configuration in the heating mode of the heat pump and to be in a second configuration in the cooling mode of the heat pump, and a controller configured to cause actuation of the reversible valve between the first configuration and the second configuration, and the reversible valve is configured to discharge the pressurized refrigerant to the reheat heat exchanger via a first port in the first configuration and the second configuration.

BRIEF DESCRIPTION OF THE DRAWINGS

Various aspects of this disclosure may be better understood upon reading the following detailed description and upon reference to the drawings in which.

DETAILED DESCRIPTION

Figure 1:
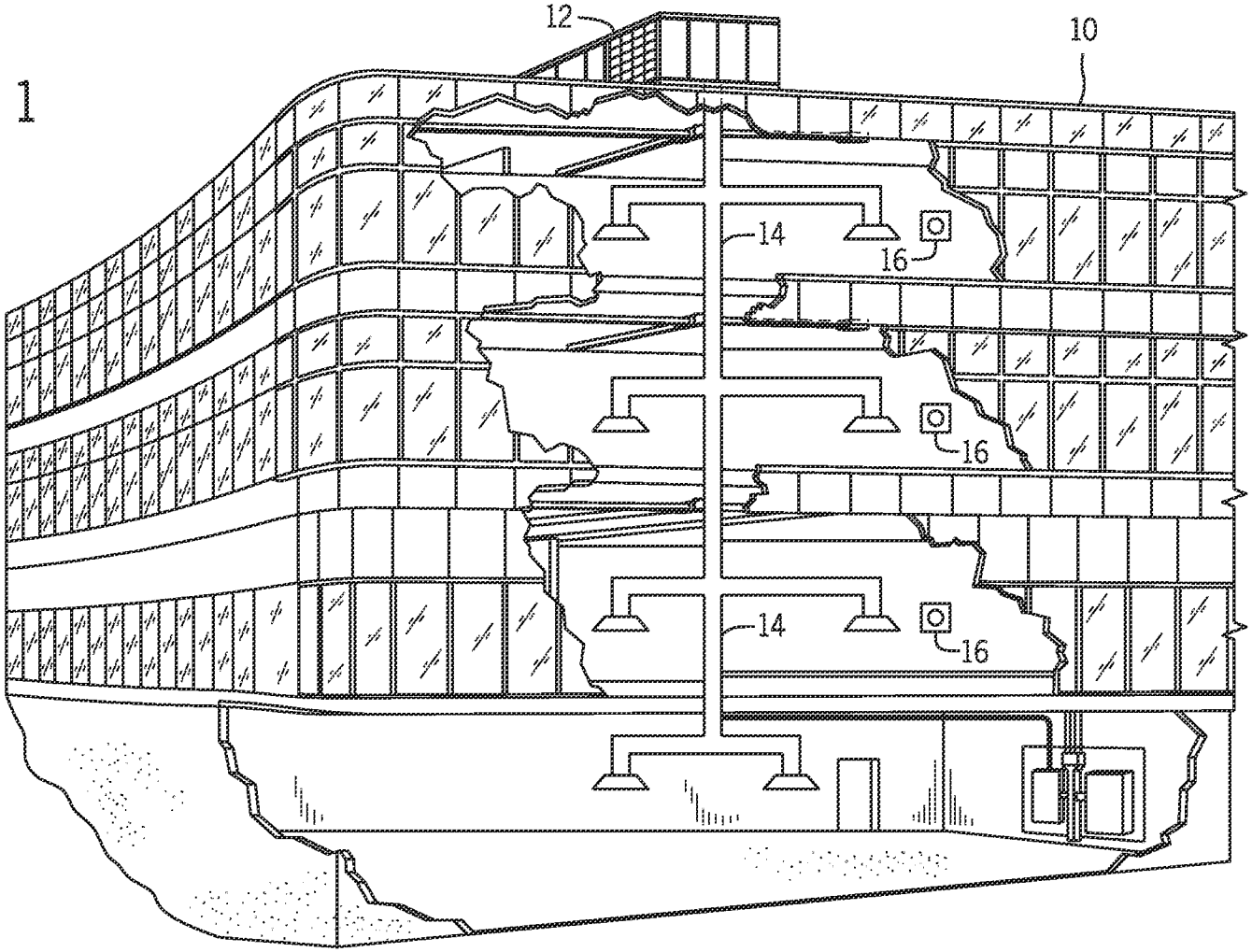
FIG. 1 is a perspective view of an embodiment of a heating, ventilation, and/or air conditioning (HVAC) system for environmental management that may employ one or more HVAC units, in accordance with an aspect of the present disclosure.

One or more specific embodiments will be described below. In an effort to provide a concise description of these embodiments, not all features of an actual implementation are described in the specification. It should be noted that in the development of any such actual implementation, as in any engineering or design project, numerous implementation-specific decisions must be made to achieve the developers' specific goals, such as compliance with system-related and business-related constraints, which may vary from one implementation to another. Moreover, it should be noted that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

The present disclosure is directed to a heating, ventilation, and/or air conditioning (HVAC) system configured to condition an air flow and to supply the conditioned air flow to a structure or building. To this end, the HVAC system may receive an air flow, which may be referred to as an entering air flow, and may include a return air flow from the building and/or an outdoor air flow from an ambient environment. The HVAC system may include a first heat exchanger configured to place the air flow in a heat exchange relationship with refrigerant flowing through the first heat exchanger. Thermal energy, such as heat, may transfer between the air flow and the refrigerant to condition the air flow. The HVAC system may then deliver the conditioned air flow as supply air flow to the building to condition a space within the building. The HVAC system may also include a second heat exchanger configured to change a temperature of the refrigerant before and after the refrigerant flows through the first heat exchanger. For example, the second heat exchanger may place the refrigerant in a heat exchange relationship with an outdoor ambient air flow in order to change the temperature of the refrigerant to enable the refrigerant to condition the air flow.

In some embodiments, the HVAC system may include a reheat heat exchanger that may be used to control the temperature and the humidity of the supply air flow. For instance, the HVAC system may use the first heat exchanger to cool the entering air flow and remove a certain amount of moisture from the entering air flow to achieve a target humidity of the generated supply air flow. The HVAC system may then use the reheat heat exchanger to heat the entering air flow to a target temperature, and then deliver the entering air flow to the structure as the supply air flow. In conventional systems, the HVAC system may include a refrigerant circuit, also referred to as a vapor compression circuit, which is configured to operate in a cooling mode or a reheat mode but not a heating mode. Thus, a supplemental heat source, such as a furnace system, may be implemented to heat the entering air flow and enable the HVAC system to heat a space within the building. However, the supplemental heat source may increase a cost associated with manufacturing and/or operating the HVAC system.

In alternative systems, the HVAC system may be a heat pump having a refrigerant circuit configured to operate in a cooling mode and in a heating mode. However, conventional heat pumps may not have a reheat heat exchanger. For this reason, the heat pump system may not sufficiently control the humidity of supply air delivered to a building, thereby limiting the functionality of the heat pump.

Thus, it is presently recognized that a refrigerant circuit configured to operate in a cooling mode and in a heating mode and that also includes a reheat heat exchanger may improve the functionality and performance of the HVAC system, while also reducing costs associated with HVAC system manufacture, operation, and maintenance. Accordingly, embodiments of the present disclosure are directed to an HVAC system having a heat pump with a reheat heat exchanger and a reversible or a reversing valve configured to enable cooling, heating, and reheat operations.

The reversible valve may be configured to alternate between a first configuration and a second configuration. In the first configuration, the reversible valve may cause the refrigerant to flow through a refrigerant circuit of the heat pump along a first flow path or direction to enable the heat pump to operate in a heating mode. In the second configuration, the reversible valve may cause the refrigerant to flow through the heat pump along a second flow path or direction of the refrigerant circuit to enable the heat pump to operate in a cooling mode. Further, in both the first configuration and the second configuration, the reversible valve may enable the refrigerant to flow through the reheat heat exchanger disposed along the refrigerant circuit, which places the refrigerant in another heat exchange relationship with the entering air flow.

The functionality of the reheat exchanger may depend on whether the heat pump is in the cooling mode or the heating mode. For example, in the heating mode, the reheat heat exchanger may be used to provide supplemental heating of the supply air flow. Thus, the reheat heat exchanger enables the heat pump to heat the space within the building more efficiently. Additionally, in the cooling mode, the reheat heat exchanger may be used to facilitate dehumidification of the entering air flow in order to achieve a target humidity and/or temperature of the supply air flow. As such, a supplemental heat source may not be utilized to provide heating capabilities, thereby reducing a cost to manufacture and/or to operate the heat pump. The reversible valve may also be used to adjust the amount of refrigerant directed to the reheat heat exchanger during the heating and/or cooling mode, thereby controlling an amount of supplemental heat or reheat provided by the reheat heat exchanger to the air flow. In this manner, the reversible valve enables greater control of the heat pump to condition the entering air flow, so as to achieve the target temperature and/or humidity of the supply air flow more accurately and/or efficiently.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
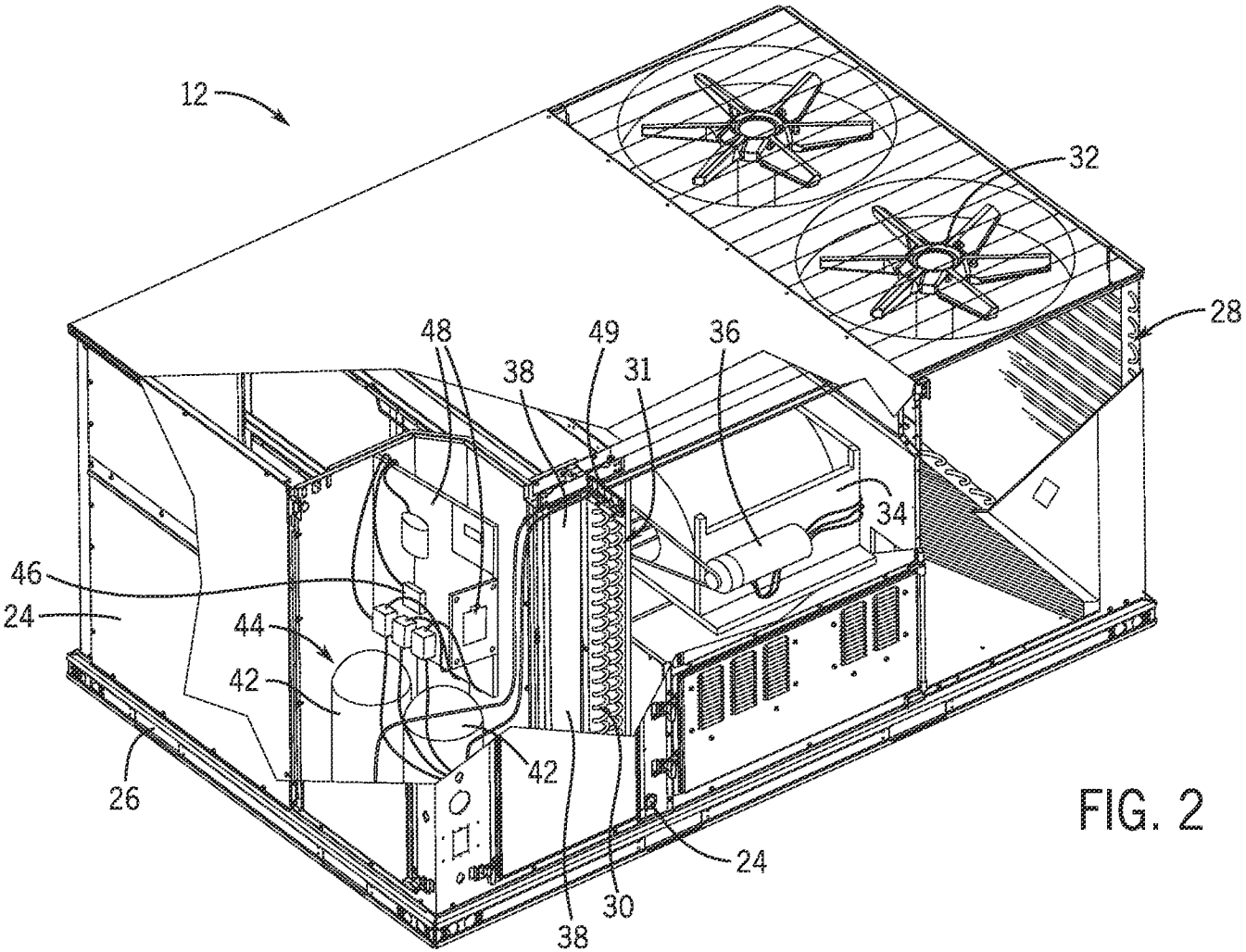
FIG. 2 is a perspective view of an embodiment of a packaged HVAC unit that may be used in the HVAC system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. Additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
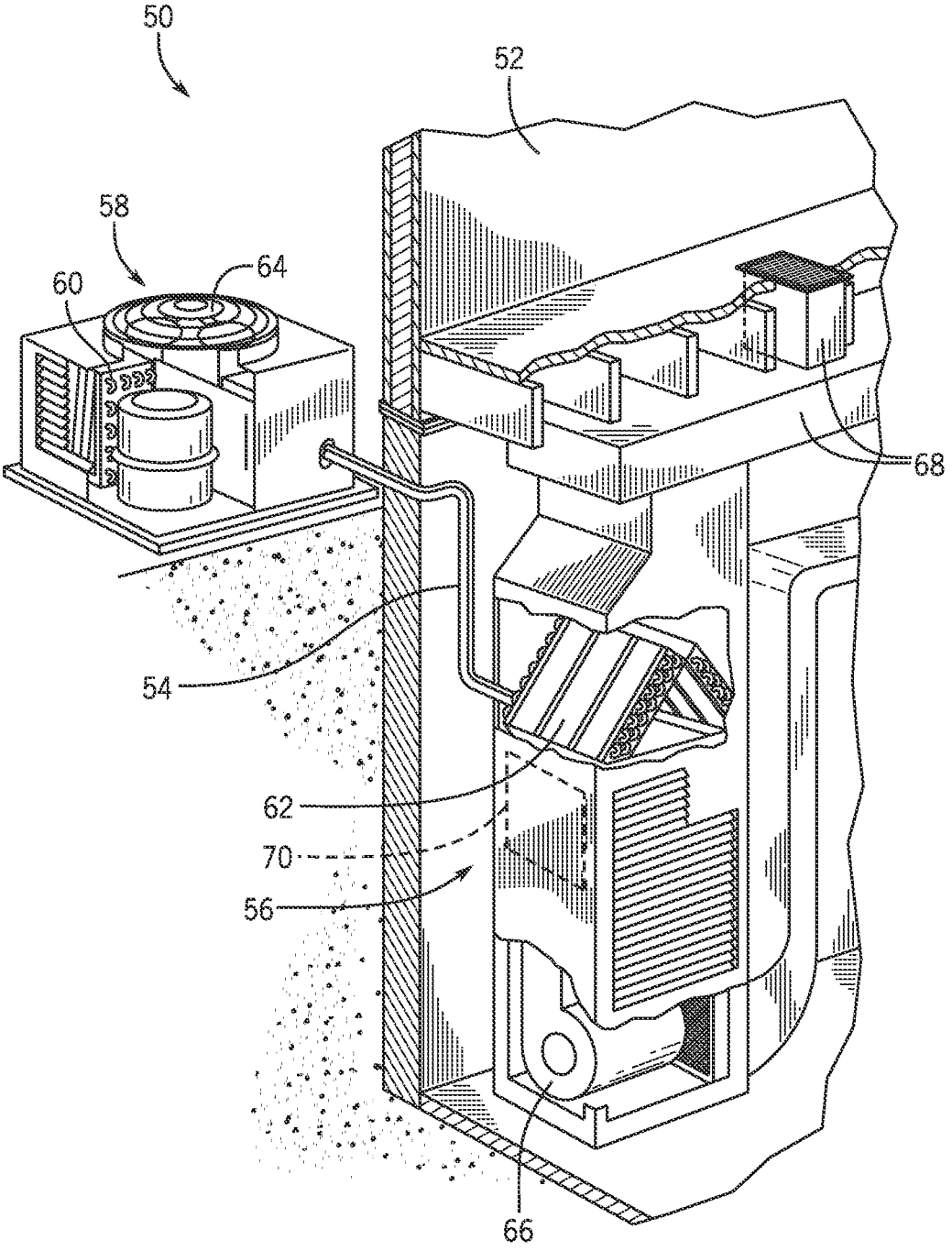
FIG. 3 is a cutaway perspective view of an embodiment of a residential, split HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
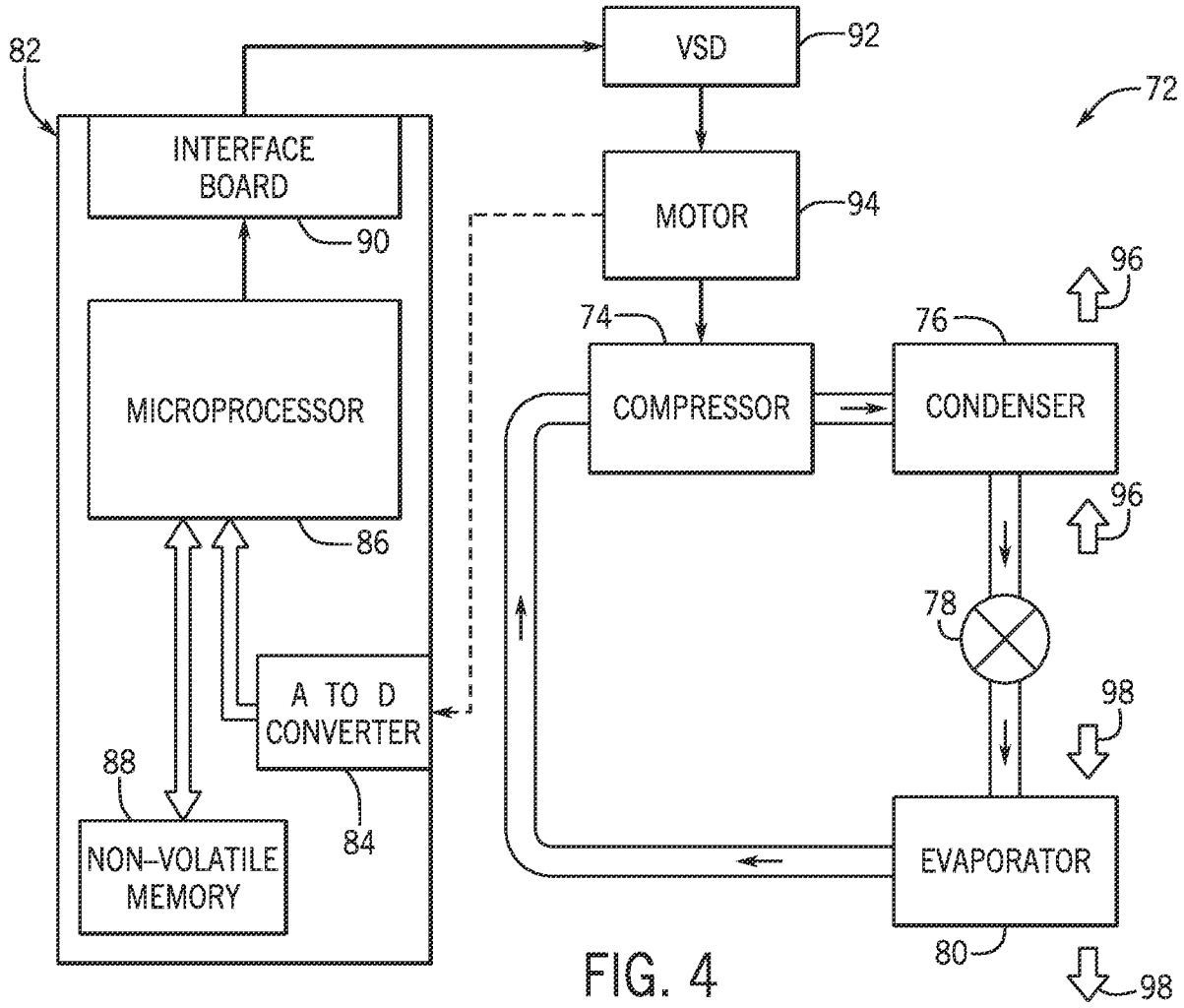
FIG. 4 is a schematic of an embodiment of a vapor compression system that can be used in any of the systems of FIGS. 1-3, in accordance with an aspect of the present disclosure, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

Any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

An HVAC system, such as the HVAC unit 12, may utilize a reheat heat exchanger to enable dehumidification of an air flow conditioned by the HVAC system. Moreover, the HVAC system may be a heat pump having a refrigerant or vapor compression circuit configured to operate in a heating mode or in a cooling mode. To this end, embodiments of the present disclosure include a reversible valve that may be alternated between a first configuration, which enables the heat pump to operate in the heating mode, and a second configuration, which enables the heat pump to operate in the cooling mode. In accordance with present techniques, the reversible valve also enables utilization of a reheat heat exchanger with the heat pump refrigerant circuit.

In the first configuration, the reversible valve may enable a refrigerant to flow along a first flow path of the refrigerant circuit. For example, the reversible valve may receive refrigerant pressurized by a compressor of the refrigerant circuit and may direct a first portion of the refrigerant to a first heat exchanger and a second portion of the refrigerant to a reheat heat exchanger. In the first configuration of the reversible valve, the reheat heat exchanger may be used to enable dehumidification of the air flow in order to achieve a target humidity of the air flow. In the second configuration, the reversible valve may enable the refrigerant to flow along a second flow path of the refrigerant circuit. For instance, the reversible valve may receive the refrigerant pressurized by the compressor and may direct a first portion of the refrigerant to a second heat exchanger and a second portion of the refrigerant to the reheat heat exchanger. In the second configuration of the reversible valve, the reheat heat exchanger may be used in conjunction with the second heat exchanger to heat the air flow.

Figure 5:
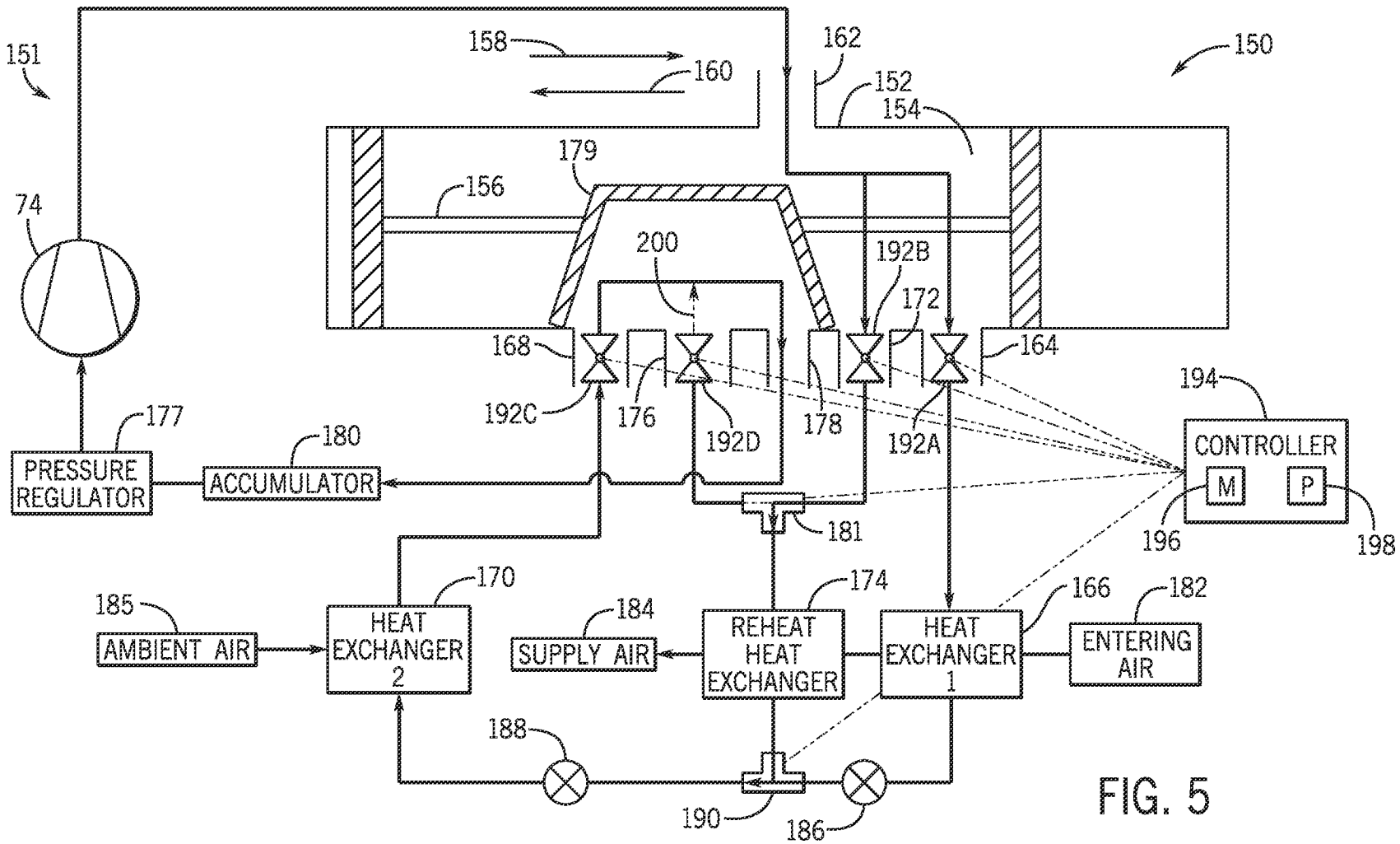
FIG. 5 is a schematic of an embodiment of an HVAC system having a reversible valve in a heating configuration to operate the HVAC system in a heating mode with reheat functionality, in accordance with an aspect of the present disclosure.

FIG. 5 is a schematic of an embodiment of an HVAC system 150 having a refrigerant circuit 151 and a reversible valve 152 configured to selectively enable operation of the HVAC system 150 in a heating mode and in a cooling mode with the refrigerant circuit 151. As such, the HVAC system 150 may be considered a heat pump system. The reversible valve 152 may include a body 154 and a slide 156 disposed within the body 154. The slide 156 may be configured to move within the body 154, such as in a first direction 158 and in a second direction 160. Based on a position of the slide 156 within the body 154, the HVAC system 150 may operate in the heating mode or in the cooling mode. In particular, the operating mode of the HVAC system 150 may be based on the flow of refrigerant through certain ports of the reversible valve 152 and thus based on a flow of the refrigerant along a particular flow path of the refrigerant circuit 151.

The reversible valve 152 includes an inlet 162 configured to receive refrigerant discharged by a compressor, such as compressor 74, disposed along the refrigerant circuit 151. The reversible valve 152 also includes a first heat exchanger port 164 that is fluidly coupled to a first heat exchanger 166 of the refrigerant circuit 151 and a second heat exchanger port 168 that is fluidly coupled to a second heat exchanger 170 of the refrigerant circuit 151. The reversible valve 152 may further include a first reheat port 172 that is fluidly coupled to a reheat heat exchanger 174 of the refrigerant circuit 151, a second reheat port 176 that is fluidly coupled to the reheat heat exchanger 174, and an outlet 178 configured to direct refrigerant toward the compressor 74, such as via an accumulator 180 configured to deliver refrigerant vapor to a suction side of the compressor 74. Although the first heat exchanger port 164, the second heat exchanger port 168, the first reheat port 172, the second reheat port 176, and the outlet 178 are aligned with one another along a common side of the body 154 in the illustrated embodiment, the ports 164, 168, 172, 176, 178 may be positioned relative to one another in any other suitable arrangement, such as in a staggered arrangement about the body 154. Additionally or alternatively, the HVAC system 150 may include a pressure regulator 177, which may be a crankcase pressure regulator, configured to regulate a flow of refrigerant into the compressor 74, such as during a startup of the operation of the compressor 74. In certain embodiments, the pressure regulator 177 may be integrated with the reversible valve 152 rather than a separate component.

The HVAC system 150 may operate the refrigerant circuit 151 in either the heating mode or the cooling mode based on the flow of refrigerant through the reversible valve 152. For example, the slide 156 may include a portion 179 having a generally U-shaped cross-section that is configured to direct the flow of refrigerant through the reversible valve 152 and through the refrigerant circuit 151 in a particular manner and/or along particular flow paths of the refrigerant circuit 151. In some embodiments, the portion 179 may have a hemispherical, conical, cup-shaped, or other suitable geometry.

In the illustrated embodiment, the reversible valve 152 is in a heating or first configuration, and the slide 156 is in a heating mode or first position to enable operation of the refrigerant circuit 151 in the heating mode. In the heating mode, refrigerant that has been pressurized and heated by the compressor 74 is directed into the reversible valve 152 via the inlet 162. Due to the position of the slide 156, the heated refrigerant may then be discharged to the reheat heat exchanger 174 via the first reheat port 172. In some embodiments, the refrigerant circuit 151 may include a first three-way valve 181 configured to regulate refrigerant flow from the first reheat port 172 to the reheat heat exchanger 174 and/or to the second reheat port 176 of the reversible valve 152. With the slide 156 in the heating mode position, refrigerant may also be discharged from the reversible valve 152 via the first heat exchanger port 164 toward the first heat exchanger 166. For instance, a first portion of the heated refrigerant may be discharged through the first heat exchanger port 164 toward the first heat exchanger 166, and a second portion of the heated refrigerant may be discharged through the first reheat port 172 to the reheat heat exchanger 174. As shown, in the heating mode position, the slide 156 blocks refrigerant flow from the inlet 162 to the second heat exchanger port 168, the second reheat port 176, and the outlet 178.

In some embodiments, the first heat exchanger 166 and the reheat heat exchanger 174 may each be placed in a heat exchange relationship with an entering air flow 182, which may include a return air flow from the building serviced by the HVAC system 150 and/or an outdoor air flow from an outdoor environment. The entering air flow 182 may be directed across the first heat exchanger 166, where heat may transfer from the first portion of the heated refrigerant to the entering air flow 182 in order to increase the temperature of the entering air flow 182 and decrease the temperature of the first portion of the heated refrigerant. Since the temperature of the first portion of the heated refrigerant decreases in the first heat exchanger 166 in the heating mode of the HVAC system 150, the first heat exchanger 166 may operate as a condenser in the heating mode of the HVAC system 150.

The entering air flow 182 may then be directed through the reheat heat exchanger 174, where heat may transfer from the second portion of the heated refrigerant to the entering air flow 182 to further increase the temperature of the entering air flow 182. The entering air flow 182 may then be delivered to the building as a supply air flow 184 to heat a space within the building. It should be noted that the heating provided by both the first heat exchanger 166 and the reheat heat exchanger 174 may sufficiently increase the temperature of the entering air flow 182 such that the entering air flow 182 is suitable to deliver to the building as the supply air flow 184 and heat the space within the building by a desired amount. In other words, an additional heat source may not be incorporated into the HVAC system 150 to provide additional heat and further increase the temperature of the entering air flow 182. Alternatively, if an additional heat source is included, the first heat exchanger 166 and the reheat heat exchanger 174 may substantially increase the temperature of the entering air flow 182, such that the additional heat source may be operated at a lower power or operating level, thereby reducing operating costs. Thus, utilization of the reheat heat exchanger 174 in conjunction with the first heat exchanger 166 to heat the entering air flow 182 may reduce a cost associated with operating the additional heat source and/or the HVAC system 150.

The refrigerant circuit 151 of the HVAC system 150 may also include a first expansion device 186 and a second expansion device 188. For example, the expansion devices 186, 188 may each be expansion valves. The expansion devices 186, 188 may each decrease a pressure of the refrigerant, thereby decreasing a temperature of the refrigerant as well. In the illustrated embodiment, the first heat exchanger 166 discharges the first portion of the refrigerant through the first expansion device 186. The first portion of the refrigerant then flows through a second three-way valve 190 where the first portion is combined with the second portion of the refrigerant discharged from the reheat heat exchanger 174. The second three-way valve 190 then directs the combined refrigerant to the second expansion device 188, which further expands the refrigerant. In additional or alternative embodiments, instead of the second three-way valve 190, a check valve and/or a two-way valve may be used to enable flow of refrigerant from the reheat heat exchanger 174 to the second expansion device 188 and to block refrigerant flow from the first expansion device 186 into the reheat heat exchanger 174. Downstream of the second expansion device 188, the refrigerant is directed through the second heat exchanger 170, where the refrigerant may be placed in a heat exchange relationship with an ambient air flow 185 from an ambient environment. Heat may transfer between the ambient environment and the refrigerant and may thereby heat the refrigerant in the heating mode. Since the temperature of the refrigerant increases in the second heat exchanger 170 in the heating mode of the HVAC system 150, the second heat exchanger 170 may operate as an evaporator in the heating mode. The second heat exchanger 170 may direct the refrigerant toward the second heat exchanger port 168 and into the reversible valve 152. In the reversible valve 152, the slide 156 may direct the refrigerant from the second heat exchanger port 168 to the outlet 178. That is, in the heating mode, the slide 156 blocks refrigerant flow from the second heat exchanger port 168 to the first heat exchanger port 164 and the first reheat port 172 and enables the refrigerant to flow from the second heat exchanger port 168 to the outlet 178. After discharging from the reversible valve 152 via the outlet 178, the refrigerant is directed toward the accumulator 180 and the compressor 74 to be pressurized and further heated.

In certain implementations, the first heat exchanger port 164, the second heat exchanger port 168, the first reheat port 172, and the second reheat port 176 may each include a valve 192 configured to enable control of an amount, such as a volumetric flowrate, of refrigerant flow through the respective ports 164, 168, 172, 176. Each valve 192 may be controlled via a controller 194 of the HVAC system 150. For example, the controller 194 may include a memory 196 and a processor 198. The memory 196 may be a mass storage device, a flash memory device, removable memory, or any other non-transitory computer-readable medium that includes instructions for the processor 198 to execute. The memory 196 may also include volatile memory such as randomly accessible memory (RAM) and/or non-volatile memory such as hard disc memory, flash memory, and/or other suitable memory formats. The processor 198 may execute the instructions stored in the memory 196, such as to control an amount of refrigerant flowing through each valve 192. As an example, the controller 194 may receive an input indicative of an operating parameter of the HVAC system 150, such as a desired temperature of the space within the building, a current temperature of the space within the building, a current humidity of the space within the building, a temperature of the entering air flow 182, a humidity of the entering air flow 182, a target temperature of the supply air flow 184, a target humidity of the supply air flow 184, another suitable parameter, or any combination thereof.

In the heating mode, the controller 194 may set the position of a first valve 192A of the first heat exchanger port 164 and the position of a second valve 192B of the first reheat port 172 to control the amount of refrigerant in the first portion discharged toward the first heat exchanger 166 and the amount of refrigerant in the second portion discharged toward the reheat heat exchanger 174, respectively. Moreover, the controller 194 may set the position of the first three-way valve 181 to enable the heated refrigerant to flow from the second valve 192B to the reheat heat exchanger 174 and to block the heated refrigerant from flowing from the second valve 192B toward the second reheat port 176. The controller 194 may also set the position of the second three-way valve 190 to enable the refrigerant to flow from the first heat exchanger 166 and from the reheat heat exchanger 174 to the second expansion device 188.

In one example, the controller 194 may set the position of the first valve 192A and the position of the second valve 192B to enable substantially the same amount of heated refrigerant to flow from the reversible valve 152 to the first heat exchanger 166 and to the reheat heat exchanger 174. As such, the first heat exchanger 166 and the reheat heat exchanger 174 may have similar heating capacities. In another example, the controller 194 may set the position of the first valve 192A and the position of the second valve 192B such that an increased amount of heated refrigerant flows through the reheat heat exchanger 174 and a decreased amount of heated refrigerant flows through the first heat exchanger 166. As such, the reheat heat exchanger 174 may have a greater heating capacity than that of the first heat exchanger 166. In a further example, the controller 194 may close the second valve 192B, such that substantially all of the heated refrigerant flows from the reversible valve 152 through the first heat exchanger 166, and substantially none of the heated refrigerant flows through the reheat heat exchanger 174. Thus, the reheat heat exchanger 174 may not be used to heat the entering air flow 182, and operation of the reheat heat exchanger 174 may be suspended or disabled. In some embodiments, remaining refrigerant contained within the reheat heat exchanger 174 may be discharged when operation of the reheat heat exchanger 174 is suspended or disabled. For instance, the controller 194 may position each of the first three-way valve 181 and the fourth valve 192D to enable any remaining refrigerant in the reheat heat exchanger 174 to flow into the reversible valve 152 via the second reheat port 176. For example, in the illustrated heating mode position of the reversible valve 152, a suction pressure generated by the compressor 74 may draw any remaining refrigerant in the reheat heat exchanger 174 through the first three-way valve 181, through the fourth valve 192D, and through the outlet 178. As such, no refrigerant may remain in the reheat heat exchanger 174.

Furthermore, in the heating mode, the controller 194 may set the position of a third valve 192C of the second heat exchanger port 168 to enable refrigerant to flow from the second heat exchanger 170 into the reversible valve 152. The controller 194 may also set the position of a fourth valve 192D of the second reheat port 176 to block the refrigerant from flowing toward the reheat heat exchanger 174 from the reversible valve 152. The suction pressure generated by the compressor 74 may also cause substantially all of the refrigerant flowing from the second heat exchanger 170 into the reversible valve 152 to discharge through the outlet 178.

The HVAC system 150 may also have a hot gas bypass mode to enable hot gas bypass flow of the refrigerant. In the hot gas bypass mode, at least a portion of the refrigerant is directed through the refrigerant circuit 151 while bypassing the reheat heat exchanger 174 and/or the first heat exchanger 166. Instead, the reversible valve 152 discharges at least a portion of the refrigerant to flow along a flow path that does not include the reheat heat exchanger 174 or the first heat exchanger 166. Generally, the hot gas bypass flow enables the compressor 74 to operate at low operating modes. In low load heating mode, there is a low demand for heating, and the HVAC system 150 may operate to slightly increase the temperature of the entering air flow 182. For example, the second portion of the heated refrigerant may be directed to flow along a flow path that does not include the reheat heat exchanger 174. The second portion of the heated refrigerant flows from the first reheat port 172 to the first three-way valve 181, which directs the second portion of the heated refrigerant to the second reheat port 176 via a first bypass flow path 200. As an example, the controller 194 may position the three-way valve 181 to enable refrigerant flow from the first reheat port 172 to the second reheat port 176 and to block refrigerant flow from the first reheat port 172 to the reheat heat exchanger 174. Furthermore, the controller 194 may position the fourth valve 192D to enable the heated refrigerant to flow through the second reheat port 176 and to mix with refrigerant entering the reversible valve 152 through the second heat exchanger port 168 and flowing toward the outlet 178. As no refrigerant is directed to the reheat heat exchanger 174, the reheat heat exchanger 174 does not provide any additional heating capabilities. In this manner, the HVAC system 150 may operate to deliver the supply air 184 without overheating the entering air flow 182 and/or without suspending the operation of the compressor 74. Indeed, in the hot gas bypass mode, the compressor 74 may operate at a reduce capacity while the HVAC system 150 satisfies a low load demand, thereby reducing operating costs of the HVAC system 150.

Figure 6:
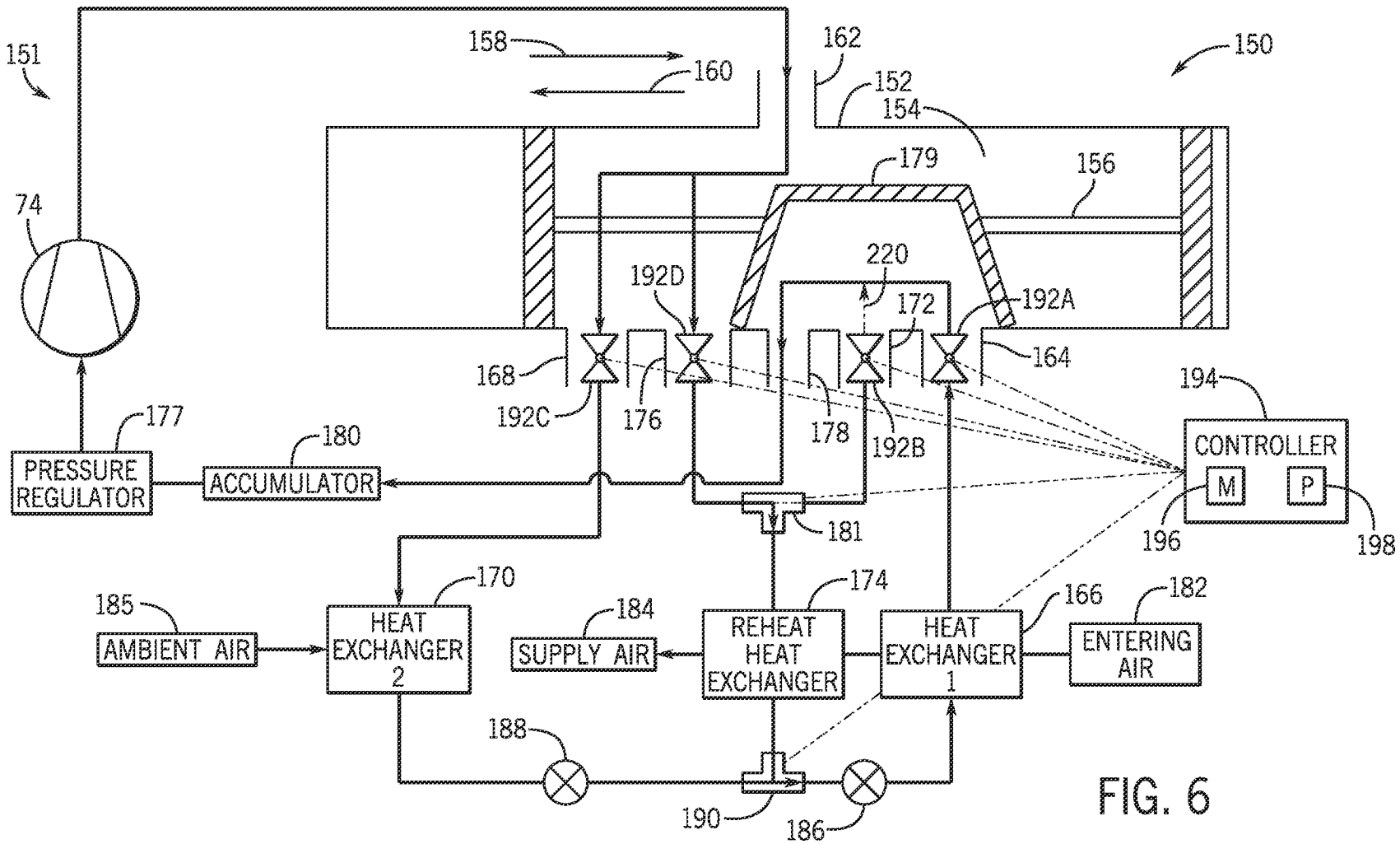
FIG. 6 is a schematic of an embodiment of an HVAC system having a reversible valve in a cooling configuration to operate the HVAC system in a cooling mode with reheat functionality, in accordance with an aspect of the present disclosure.

FIG. 6 is a schematic of an embodiment of the HVAC system 150, in which the reversible valve 152 is in a cooling or second configuration, and the slide 156 is in a cooling mode or second position to enable operation of the refrigerant circuit 151 in the cooling and/or dehumidification mode. During the cooling and/or dehumidification mode, the reversible valve 152 receives refrigerant that has been pressurized and heated by the compressor 74 via the inlet 162. The position of the slide 156 enables a first portion of the heated refrigerant to be discharged through the second heat exchanger port 168 to the second heat exchanger 170. Furthermore, a second portion of the heated refrigerant is discharged from the reversible valve 152 through the second reheat port 176 toward the first three-way valve 181 and then to the reheat heat exchanger 174. To this end, in the cooling mode, the slide 156 blocks refrigerant flow from the inlet 162 to the first heat exchanger port 164, the first reheat port 172, and the outlet 178.

The first portion of the heated refrigerant directed to the second heat exchanger 170 may be placed in a heat exchange relationship with the ambient air flow 185, which may cause heat to transfer from the heated refrigerant to the ambient air flow 185. Thus, the first portion of the heated refrigerant may be cooled, and the second heat exchanger 170 may operate as a condenser in the cooling mode of the HVAC system 150. The second heat exchanger 170 may discharge the first portion of the heated refrigerant to the second expansion device 188, which may expand and further cool the first portion of the refrigerant. The first portion of the heated refrigerant may then be directed to the second three-way valve 190.

The second portion of heated refrigerant that is directed through the reheat heat exchanger 174 is utilized therein for reheat and dehumidification of the entering air 182, as discussed below. After discharging from the reheat heat exchanger 174, the second portion of the refrigerant is directed to the second three-way valve 190. However, as the second portion of the heated refrigerant has not been expanded by an expansion device or valve before entering the second three-way valve 190, the second portion of the heated refrigerant may have a temperature higher than the first portion of the heated refrigerant received by the second three-way valve 190 from the second expansion device 188. Nevertheless, the first and second portions of the heated refrigerant may combine with one another at the second three-way valve 190 and may be directed to the first expansion device 186. At the first expansion device 186, the combined refrigerant may expand and cool and may then be directed to the first heat exchanger 166. In this manner, the refrigerant flowing through the first heat exchanger 166 may be at a substantially lower temperature than the temperature of the second portion of the heated refrigerant flowing through the reheat heat exchanger 174. The first heat exchanger 166 may then direct the refrigerant through the first heat exchanger port 164 and into the reversible valve 152, where the portion 179 of the slide 156 may direct the refrigerant out of the slide 156 via the outlet 178 and toward the compressor 74 to be pressurized. Thus, in the cooling mode, the slide 156 blocks refrigerant flow from the first heat exchanger port 164 to the second heat exchanger port 168 and to the second reheat port 176.

The first heat exchanger 166 and the reheat heat exchanger 174 may each place the refrigerant in a heat exchange relationship with the entering air flow 182 in the cooling mode. As noted above, the temperature of the combined refrigerant in the first heat exchanger 166 may be substantially lower than the temperature of the first portion of the heated refrigerant in the reheat heat exchanger 174. Thus, heat may transfer from the entering air flow 182 to the refrigerant in the first heat exchanger 166, thereby cooling the entering air flow 182 and heating the refrigerant. As such, the first heat exchanger 166 may operate as an evaporator in the cooling mode of the HVAC system 150. Cooling the entering air flow 182 may condense and remove moisture from the entering air flow 182, thereby reducing a humidity of the entering air flow 182, such as toward a target humidity. The cooled entering air flow 182 may then be directed to the reheat heat exchanger 174, where heat may transfer from refrigerant to the entering air flow 182 to heat the entering air flow 182, such as toward a target temperature. The entering air flow 182 may then be delivered to the building as the supply air flow 184.

In the cooling mode, the entering air flow 182 may be conditioned via the first heat exchanger 166 and/or the reheat heat exchanger 174 to achieve a target humidity and/or temperature of the supply air flow 184 in order to provide a more comfortable supply air flow 184 to the space within the building. For example, the first heat exchanger 166 may be used to reduce the temperature of the entering air flow 182 to a first target temperature in order to remove a certain amount of moisture from the entering air flow 182 and to achieve a target humidity of the entering air flow 182. However, the first target temperature may be unsuitable, such as too low, for the supply air flow 184. In other words, by cooling and dehumidifying the entering air flow 182 with the first heat exchanger 166, the temperature of the entering air flow 182 may fall below a desired temperature to cool the space within the building. For this reason, the reheat heat exchanger 174 may be utilized to increase the temperature of the entering air flow 182 to a second target temperature, which may be a more suitable temperature for the supply air flow 184, while maintaining the humidity of the entering air flow 182 at the target humidity. Thus, using the reheat heat exchanger 174 may enable the HVAC system 150 to deliver a more comfortable supply air flow 184 to the building.

In some embodiments, the controller 194 may set the position of the third valve 192C of the second heat exchanger port 168 and the position of the fourth valve 192D of the second reheat port 176 to control the amount of heated refrigerant in the first portion discharged toward the second heat exchanger 170 and the amount of heated refrigerant in the second portion discharged toward the reheat heat exchanger 174, respectively. The controller 194 may also set the position of the first three-way valve 181 to enable the heated refrigerant to flow from the fourth valve 192D to the reheat heat exchanger 174 and to block the heated refrigerant from flowing from the fourth valve 192D toward the first reheat port 172. Further, the controller 194 may set the position of the second three-way valve 190 to enable the refrigerant to flow from the second heat exchanger 170 and from the reheat heat exchanger 174 to the first expansion device 186.

The controller 194 may set the position of the third valve 192C and the position of the fourth valve 192D to enable the reheat heat exchanger 174 to provide a target amount of reheating and/or to enable the first heat exchanger 166 to provide a target amount of cooling and/or dehumidification. For example, if increased reheating by the reheat heat exchanger 174 is desired, the controller 194 may set the positions of the third valve 192C and the fourth valve 192D such that the amount of heated refrigerant discharged to the reheat heat exchanger 174 is increased and the amount of heated refrigerant discharged to the second heat exchanger 170 is decreased. If no reheating by the reheat heat exchanger 174 is desirable, the controller 194 may close the fourth valve 192D, such that substantially all of the heated refrigerant is discharged from the reversible valve 152 to the second heat exchanger 170. Thus, no refrigerant may flow through the reheat heat exchanger 174, and the controller 194 may suspend or disable operation of the reheat heat exchanger 174. In some embodiments, when the reheat heat exchanger 174 is not in operation, the reheat heat exchanger 174 may discharge remaining refrigerant within the reheat heat exchanger 174 from previous operation. For example, the controller 194 may set the first three-way valve 181 and the second valve 192B to enable the remaining refrigerant in the reheat heat exchanger 174 to flow into the reversible valve 152 via the first reheat port 172, such as due to a suction pressure generated by the compressor 74, as similarly described above.

In the cooling and/or dehumidification mode, the controller 194 may set the position of the first valve 192A of the first heat exchanger port 164 to enable refrigerant to flow from the first heat exchanger 166 into the reversible valve 152. Also, the controller 194 may set the position of the second valve 192B of the first reheat port 172 to block refrigerant flow toward the reheat heat exchanger 174 from the first reheat port 172. Thus, substantially all of the refrigerant flowing from the first heat exchanger 166 into the reversible valve 152 is discharged through the outlet 178.

The HVAC system 150 may also operate in a hot gas bypass mode in the during cooling and/or dehumidification operations. That is, the HVAC system 150 may enable hot gas bypass flow of the refrigerant in the cooling mode to enable the compressor 74 to operate in a low load cooling mode. In the low load cooling mode, there is a low demand for cooling and/or a low demand for dehumidification, and the HVAC system 150 may operate to slightly reduce the temperature of the entering air flow 182 without substantially changing the humidity of the entering air flow 182. For example, the HVAC system 150 may be configured to discharge the second portion of the heated refrigerant from the reversible valve 152 to flow along a flow path of the refrigerant circuit 151 that bypasses the reheat heat exchanger 174.

In one embodiment, the controller 194 may set the position of the first three-way valve 181 to enable the second portion of the heated refrigerant to flow from the second reheat port 176 to the first three-way valve 181 and from the first three-way valve 181 to the first reheat port 172 while blocking the heated refrigerant from flowing from the second reheat port 176 to reheat heat exchanger 176. The controller 194 may further set the position of the second valve 192B to enable the heated refrigerant to flow from the first three-way valve 181 through the second heat exchanger port 172 along a second bypass flow path 220. The heated refrigerant may then combine with refrigerant flowing through the first heat exchanger port 164 from the first heat exchanger 166, and the combined refrigerant may flow toward the outlet 178. By increasing the amount of heated refrigerant directed through the second reheat port 176 to bypass the reheat heat exchanger 174, less heated refrigerant may be directed through the second heat exchanger 170 and then to the first heat exchanger 166. Thus, the cooling capacity of the first heat exchanger 166 may decrease. In other words, with a reduced refrigerant flow through the second heat exchanger 170 and the first heat exchanger 166, and with no refrigerant flow through the reheat heat exchanger 174, the HVAC system 150 may be operated to slightly cool the entering air flow 182 without substantially changing the humidity of the entering air flow 182 and/or without suspending operation of the compressor 74. Indeed, in the hot gas bypass mode, the compressor 74 may operate at a reduce capacity while the HVAC system 150 satisfies a low load demand, thereby reducing operating costs of the HVAC system 150.

Figure 7:
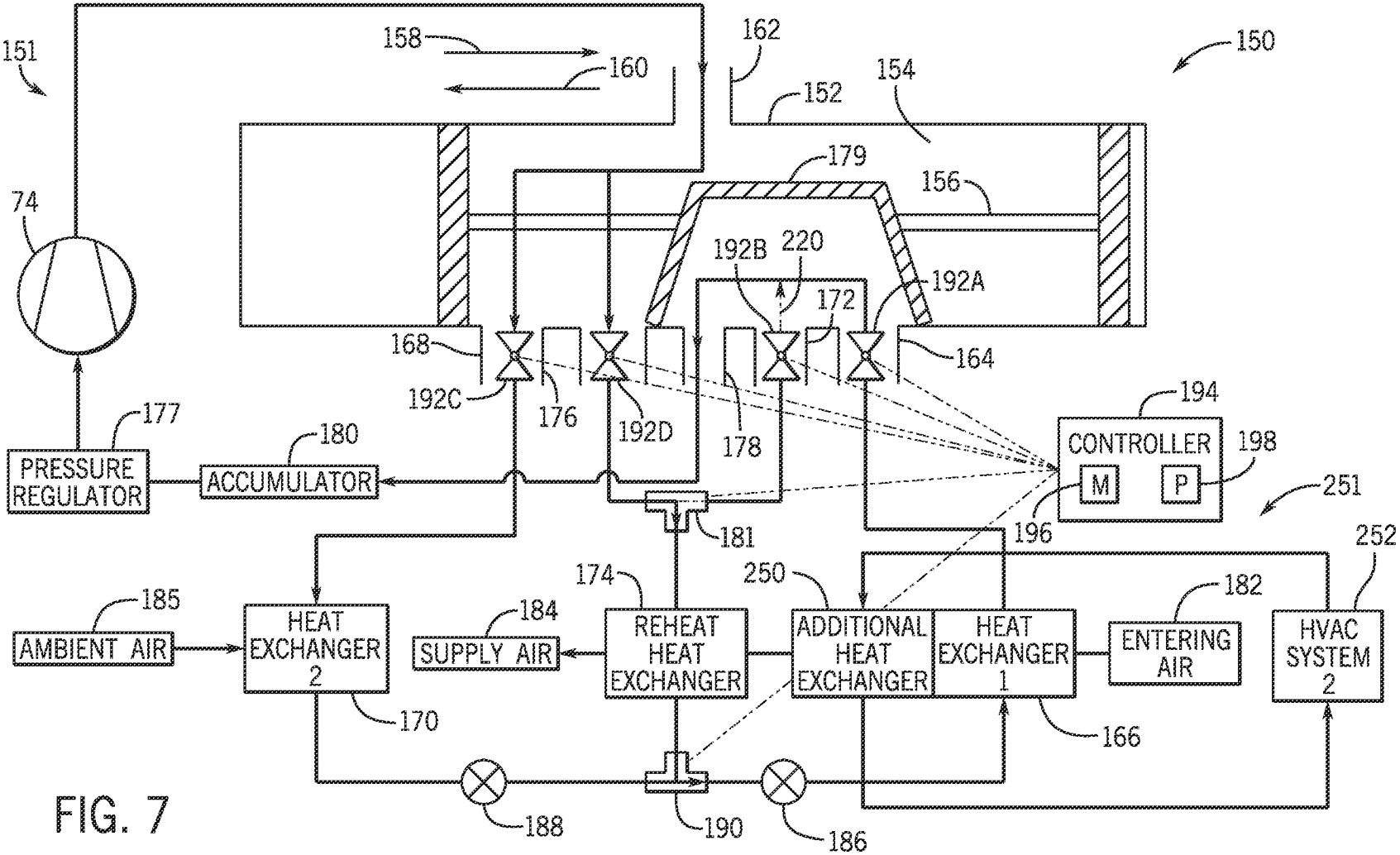
FIG. 7 is a schematic of an embodiment of an HVAC system having a reversible valve and an additional heat exchanger shared by an additional HVAC system, in accordance with an aspect of the present disclosure.

FIG. 7 is a schematic of an embodiment of the HVAC system 150 having the reversible valve 152 and an additional heat exchanger 250 shared by an additional HVAC system 252, which may be another vapor compression system or a second refrigerant circuit 251. The additional HVAC system 252 may be considered a part of or integrated with the HVAC system 150. In some embodiments, the additional heat exchanger 250 may be integrated or packaged with the first heat exchanger 166. For example, the first heat exchanger 166 and the additional heat exchanger 250 may each be a separate section of a common heat exchanger, which may have a face split arrangement, a row split arrangement, an interlaced split arrangement, another suitable arrangement, or any combination thereof that fluidly separates the first heat exchanger 166 from the additional heat exchanger 250. In other words, the first heat exchanger 166 may flow a first refrigerant circulated within the refrigerant circuit 151, and the additional HVAC system 252 may flow a second refrigerant circulated within the second refrigerant circuit 251.

The HVAC system 252 may condition the entering air flow 182 via the second refrigerant. By way of example, the additional HVAC system 252 may direct the second refrigerant through the additional heat exchanger 250, which places the second refrigerant in a heat exchange relationship with the entering air flow 182. In the illustrated embodiment, the entering air flow 182 is directed through the first heat exchanger 166 to transfer heat with the refrigerant from the HVAC system 150, then through the additional heat exchanger 250 to transfer heat with the second refrigerant from the additional HVAC system 252, and then through the reheat heat exchanger 174 to transfer additional heat with the refrigerant from the HVAC system 150.

The additional HVAC system 252 may also be configured to operate in a cooling mode and in a heating mode. For example, the additional HVAC system 252 may be a heat pump. In some embodiments, both the HVAC system 150 and the additional HVAC system 252 may be operated in the cooling mode, such that the additional heat exchanger 250 provides supplemental cooling of the entering air flow 182. In alternative embodiments, the HVAC system 150 may be operated in the cooling mode, and the additional HVAC system 252 may be operated in the heating mode. In such embodiments, the additional heat exchanger 250 may provide supplemental reheating of the entering air flow 182 after the entering air flow 182 has been cooled via the first heat exchanger 166. In further embodiments, both the HVAC system 150 and the additional HVAC system 252 may be operated in the heating mode. Thus, the first heat exchanger 166, the reheat heat exchanger 174, and the additional heat exchanger 250 may each heat the entering air flow 182.

Figure 8:
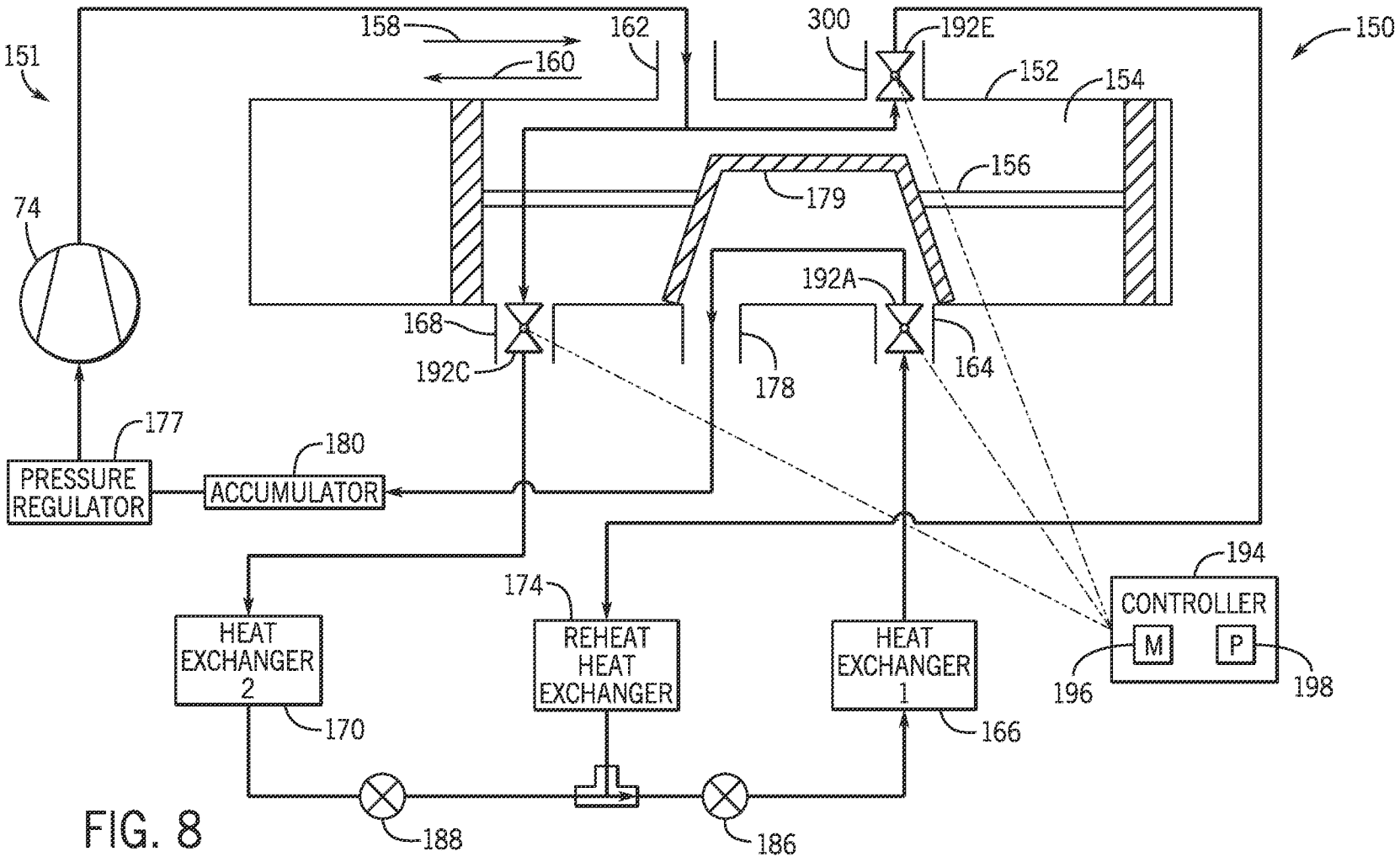
FIG. 8 is a schematic of an embodiment of an HVAC system having a reversible valve configured to operate the HVAC system in a heating mode with reheat functionality or a cooling mode with reheat functionality, in accordance with an aspect of the present disclosure.

FIG. 8 is a schematic of an embodiment of the HVAC system 150 having the reversible valve 152 positioned to operate the HVAC system 150 in the cooling mode. In the illustrated embodiment, the reversible valve 152 includes a single reheat port 300, instead of the first reheat port 172 and the second reheat port 176. In the illustrated embodiment, in which the reversible valve 152 is in the cooling configuration and the slide 156 is in the cooling mode position, heated refrigerant flowing into the reversible valve 152 from the compressor 74 may be discharged to the second heat exchanger 170 via the second heat exchanger port 168 and/or to the reheat heat exchanger 174 via the reheat port 300. Conversely, in the heating mode, in which the reversible valve 152 is in the heating configuration and the slide 156 is in the heating position, heated refrigerant flowing into the reversible valve 152 may be discharged to the first heat exchanger 166 via the first heat exchanger port 164 and/or to the reheat heat exchanger 174 via the reheat port 300. In other words, in both the heating mode and the cooling mode, heated refrigerant may be discharged out of the reversible valve 152 through the reheat port 300 toward the reheat heat exchanger 174. Although the reheat port 300 is aligned with and adjacent to the inlet 162 in the illustrated embodiment, the reheat port 300 may be positioned in any suitable manner along the body 154 of the reversible valve 152.

It should be noted that, in the illustrated embodiment, operation of the HVAC system 150 in the heating mode and in the cooling mode may be similar to the techniques described above with reference to FIGS. 5 and 6. For instance, a fifth valve 192E may be disposed in or along the reheat port 300 and may be controlled by the controller 194 to adjust an amount, such as a volumetric flowrate, of heated refrigerant directed to the reheat heat exchanger 174. By way of example, in the cooling mode, the controller 194 may set the position of the third valve 192C of the second heat exchanger port 168 and the position of the fifth valve 192E of the reheat port 300 to control the amount of heated refrigerant flowing to the second heat exchanger 170 relative to the amount of heated refrigerant flowing to the reheat heat exchanger 174. In the heating mode, the controller 194 may set the position of the first valve 192A of the first heat exchanger port 164 and the position of the fifth valve 192E of the reheat port 300 to control the amount of heated refrigerant flowing to the first heat exchanger 166 relative to the amount of heated refrigerant flowing to the reheat heat exchanger 174. It should also be noted that, since the reheat port 300, rather than separate reheat ports 172, 176, is used to direct refrigerant to the reheat heat exchanger 174, the HVAC system 150 may not have the first three-way valve 181. In certain embodiments, the reheat port 300 may be fluidly coupled to the compressor 74 to enable refrigerant to be directed from the reheat port 300 toward the compressor 74 and enable features of hot gas bypass similarly discussed above.

Figure 9:
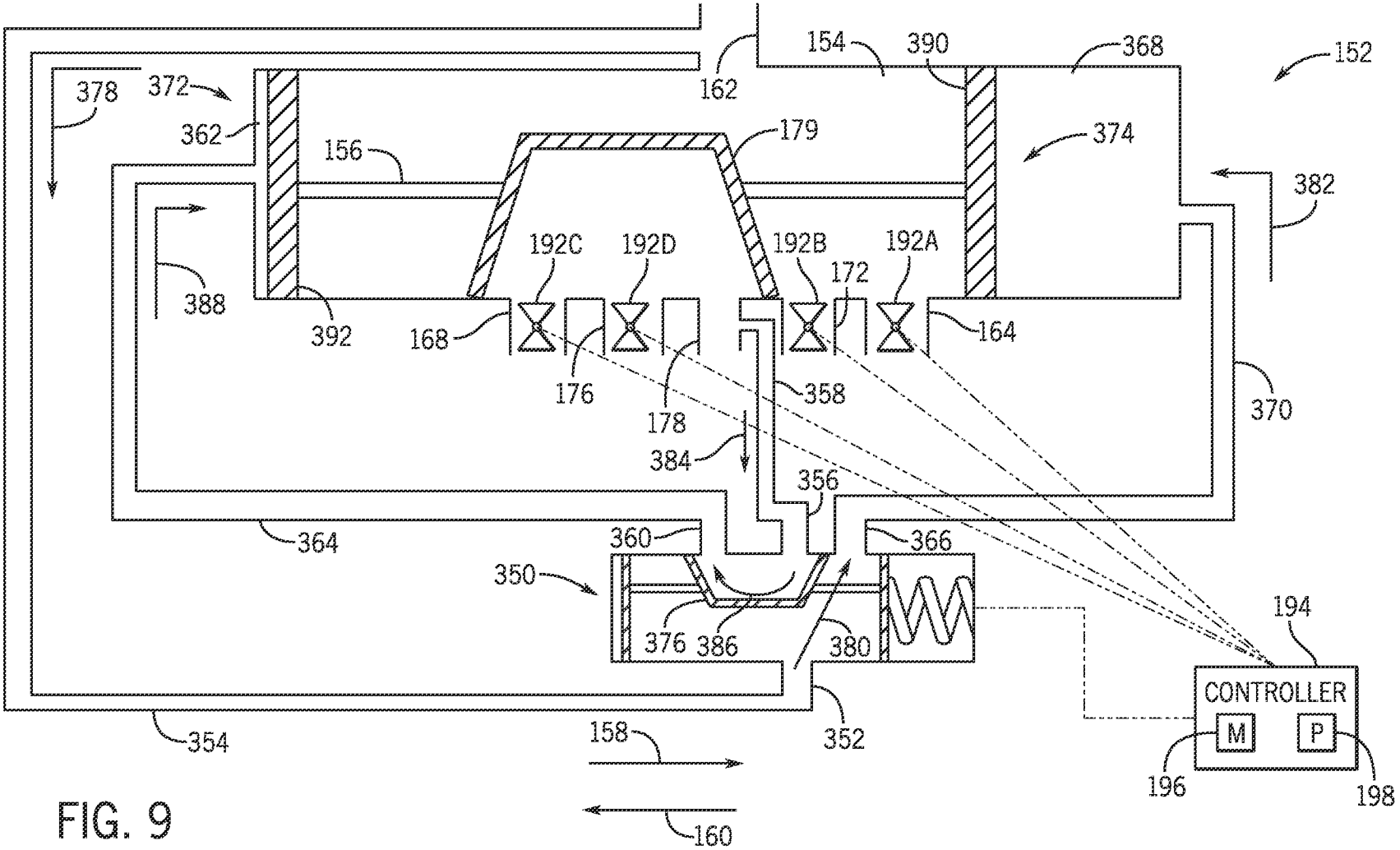
FIG. 9 is a schematic of an embodiment of a reversible valve fluidly coupled to a pilot valve positioning the reversible valve in a cooling configuration, in accordance with an aspect of the present disclosure.

FIG. 9 is a schematic of an embodiment of the reversible valve 152, which is fluidly coupled to a pilot valve 350 configured to adjust the position of the slide 156 within the body 154 of the reversible valve 152. The pilot valve 350 includes a first port 352 that is fluidly coupled to the inlet 162 of the reversible valve 152 via a first pilot line 354. The pilot valve 350 also includes a second port 356 that is fluidly coupled to the outlet 178 of the reversible valve 152 via a second pilot line 358. The pilot valve 350 may further include a third port 360, which is fluidly coupled to a first chamber 362 in the body 154 of the reversible valve 152 via a third pilot line 364, and a fourth port 366, which is fluidly coupled to a second chamber 368 opposite the first chamber 362 in the body 154 of the reversible valve 152 via a fourth pilot line 370.

The first chamber 362 may enable fluid flow from the pilot valve 350 to a first side 372 of the slide 156, and the second chamber 368 may enable fluid flow from the pilot valve 350 to a second side 374 of the slide 156. In the illustrated embodiment, the reversible valve 152 is in the heating configuration to enable the HVAC system 150 to operate in the heating mode. To set the reversible valve 152 in the heating configuration, the controller 194 may actuate the pilot valve 350 to drive a pilot slide 376 in the second direction 160 to a first pilot valve position. In some embodiments, the pilot valve 350 may be a solenoid valve, and the controller 194 may transmit an electrical current through a coil of the solenoid valve to create a magnetic field that drives the pilot slide 376 in the second direction 160. In additional or alternative embodiments, the pilot valve 350 may include an actuator that the controller 194 may activate to drive the pilot slide 376 in the second direction 160.

While the pilot slide 376 is in the first pilot valve position, some refrigerant pressurized by the compressor 74 may flow from the inlet 162 through the first pilot line 354 in a first flow direction 378 and into the pilot valve 350 via the first port 352. The pilot slide 376 may then direct the pressurized refrigerant in a second flow direction 380 out of the pilot valve 350 via the fourth port 366, through the fourth pilot line 370, and in a third flow direction 382 into the second chamber 368. That is, the pilot slide 376 blocks the pressurized refrigerant from flowing from the first port 352 through the second port 356 or the third port 360 when in the first pilot valve position. Additionally, some of the refrigerant, which may have been depressurized via the expansion devices 186, 188, flowing out of the body 154 of the reversible valve 152 via the outlet 178 may flow through the second pilot line 358 in a fourth flow direction 384 and into the pilot valve 350 via the second port 356. The position of the pilot slide 376 may block the refrigerant from flowing from the second port 356 to the first port 352 or the fourth port 366. Instead, the pilot slide 376 may direct the refrigerant in a fifth flow direction 386 to flow out of the pilot valve 350 via the third port 360, through the third pilot line 364, and in a sixth flow direction 388 into the first chamber 362. The pressure of the refrigerant directed into the second chamber 368 from the compressor 74 via the pilot valve 350 may be greater than the pressure of the refrigerant directed into the first chamber 362 from the outlet 178 of the reversible valve 152. As a result, the refrigerant in the second chamber 368 may exert a greater force onto a first slide piston 390 disposed on the second side 374 of the slide 156 than a force exerted on a second slide piston 392 disposed on the first side 372 of the slide 156 by the refrigerant in the first chamber 362. Therefore, the slide 156 is driven in the second direction 160 to the heating position, which enables the reversible valve 152, and thus the HVAC system 150, to operate in the heating mode.

Figure 10:
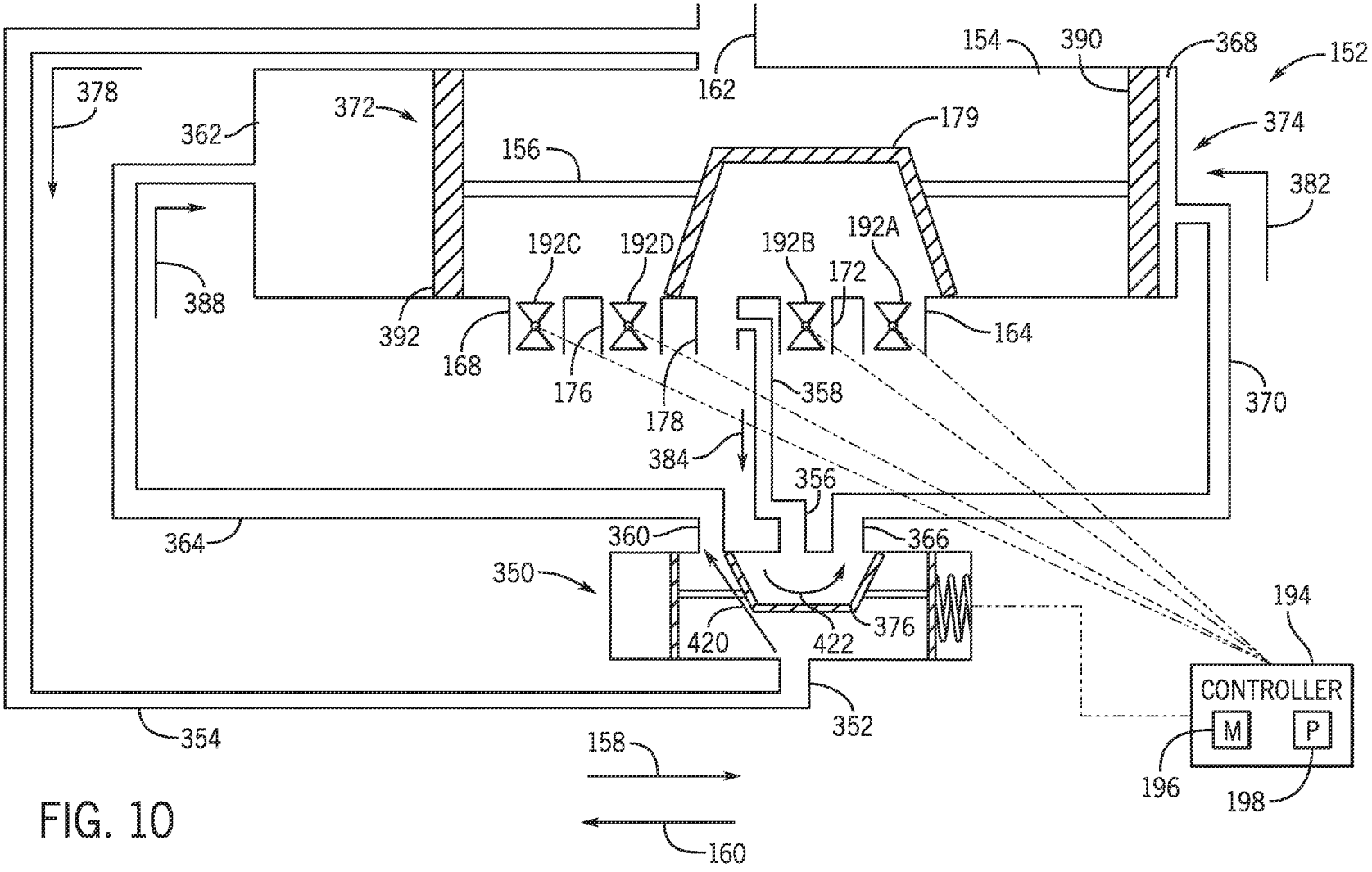
FIG. 10 is a schematic of an embodiment of a reversible valve fluidly coupled to a pilot valve positioning the reversible valve in a heating configuration, in accordance with an aspect of the present disclosure.

FIG. 10 is a schematic of an embodiment of the reversible valve 152 fluidly coupled to the pilot valve 350 and in the cooling configuration. To this end, the controller 194 may actuate the pilot slide 376 to move in the first direction 158 into a second pilot valve position. While the pilot slide 376 is in the second pilot valve position, some refrigerant pressurized by the compressor 74 may flow from the inlet 162 of the reversible valve 152, through the first pilot line 354 in the first flow direction 378, and into the pilot valve 350 via the first port 352. The pilot slide 376 may then direct the pressurized refrigerant in a seventh flow direction 420 out of the pilot valve 350 via the third port 360, through the third pilot line 364, and then to the first chamber 362. Thus, in the second pilot valve position, the pilot slide 376 blocks the pressurized refrigerant from flowing from the first port 352 to the second port 356 or the fourth port 366. Some of the refrigerant flowing out of the outlet 178 may flow through the second pilot line 358 in the fourth flow direction 384 into the pilot valve 350 via the second port 356, and the pilot slide 376 may block refrigerant from flowing from the second port 356 to the first port 352 or the third port 360. Thus, the refrigerant may be directed in an eighth flow direction 422 to flow out of the pilot valve 350 via the fourth port 366. The refrigerant may then flow through the fourth pilot line 370 and into the second chamber 368. In the second pilot valve position, the pressure of the refrigerant directed into the first chamber 362 may be greater than the pressure of the refrigerant directed into the second chamber 368. Thus, the refrigerant in the first chamber 362 may impart a greater force onto the second slide piston 392 on the first side 372 of the slide 156 than a force imparted by the refrigerant onto the first slide piston 390 in the second chamber 368. As such, the slide 156 is driven in the first direction 158 to the cooling mode position, thereby enabling the reversible valve 152 and the HVAC system 150 to operate in the cooling mode.

The present disclosure is directed to an HVAC system, such as a heat pump, having a reversible valve and a reheat heat exchanger to facilitate conditioning of an air flow delivered to a building. A first configuration of the reversible valve may enable the heat pump to operate in a heating mode, and a second configuration of the reversible valve may enable the heat pump to operate in a cooling mode. In both the heating mode and the cooling mode, the reversible valve may receive pressurized refrigerant from a compressor of the heat pump and may discharge the pressurized refrigerant to the reheat heat exchanger of the heat pump. In the heating mode, a heat exchanger of the heat pump may be operated to heat the air flow, and the reheat heat exchanger may provide further heating of the air flow and increase the efficiency of the heat pump to heat the building. In the cooling mode, the heat exchanger of the heat pump may be operated to cool the air flow, and the reheat heat exchanger may provide reheating capabilities that enable greater temperature and humidity control of the air flow. Thus, the reheat heat exchanger may enable the heat pump to provide a more comfortable air flow to the building. It should be noted that existing HVAC systems or heat pumps may be retrofitted with the reversible valve described in this disclosure. In other words, the reversible valve may be implemented onto an existing heat pump to enable the existing heat pump to operate in either the heating mode or the cooling mode and to direct refrigerant from the compressor to the reheat heat exchanger. The technical effects and technical problems in the specification are examples and are not limiting. It should be noted that the embodiments described in the specification may have other technical effects and can solve other technical problems.

While only certain features and embodiments of the disclosure have been illustrated and described, many modifications and changes may occur to those skilled in the art, such as variations in sizes, dimensions, structures, shapes and proportions of the various elements, values of parameters, including temperatures and pressures, mounting arrangements, use of materials, colors, orientations, and so forth without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be noted that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A heating, ventilation, and/or air conditioning (HVAC) system, comprising:

a reheat heat exchanger disposed along a refrigerant circuit, wherein the reheat heat exchanger is configured to transfer heat from a refrigerant to an air flow in a heating mode of the HVAC system and in a cooling mode of the HVAC system;

a reversible valve disposed along the refrigerant circuit, wherein the reversible valve is adjustable between a first configuration corresponding to the cooling mode and a second configuration corresponding to the heating mode, the reversible valve is configured to direct the refrigerant through the refrigerant circuit in a first flow direction in the first configuration and to direct the refrigerant through the refrigerant circuit in a second flow direction in the second configuration, wherein the reversible valve comprises a reheat port, and the reversible valve is configured to direct the refrigerant toward the reheat heat exchanger via the reheat port in the first configuration and in the second configuration; and a valve associated with the reheat port, wherein the valve is configured to adjust an amount of the refrigerant directed from the reversible valve to the reheat heat exchanger via the reheat port.

2. The HVAC system of claim 1, wherein the reversible valve comprises an inlet, and the reversible valve is configured to receive the refrigerant from a compressor disposed along the refrigerant circuit via the inlet in the first configuration and in the second configuration.

3. The HVAC system of claim 2, wherein the reversible valve comprises an outlet, and the reversible valve is configured to direct the refrigerant to the compressor via the outlet in the first configuration and in the second configuration.

4. The HVAC system of claim 3, wherein the reversible valve comprises a first heat exchanger port and a second heat exchanger port, and, in the first configuration:

the reversible valve is configured to receive the refrigerant from a first additional heat exchanger disposed along the refrigerant circuit via the first heat exchanger port, and the reversible valve is configured to direct the refrigerant to a second additional heat exchanger disposed along the refrigerant circuit via the second heat exchanger port.

5. The HVAC system of claim 4, wherein, in the second configuration:

the reversible valve is configured to receive the refrigerant from the second additional heat exchanger via the second heat exchanger port, and the reversible valve is configured to direct the refrigerant to the first additional heat exchanger via the first heat exchanger port.

6. The HVAC system of claim 4, wherein the reheat port is disposed opposite the outlet, the first heat exchanger port, and the second heat exchanger port, relative to a body of the reversible valve.

7. The HVAC system of claim 2, wherein the inlet and the reheat port are aligned along a length of a body of the reversible valve.

8. The HVAC system of claim 1, comprising a controller communicatively coupled to the valve associated with the reheat port, wherein the controller is configured to adjust the valve to control an amount of reheat provided by the reheat heat exchanger to the air flow in the cooling mode, and the controller is configured adjust the valve to control an amount of supplemental heating provided by the reheat heat exchanger to the air flow in the heating mode.

9. A heating, ventilation, and/or air conditioning (HVAC) system, comprising:

a refrigerant circuit;

a reheat heat exchanger disposed along the refrigerant circuit, wherein the reheat heat exchanger is configured to transfer heat from a refrigerant to an air flow directed through the HVAC system in a heating mode of the HVAC system and in a cooling mode of the HVAC system; and a reversing valve disposed along the refrigerant circuit, wherein the reversing valve is configured to adjust a flow direction of the refrigerant along the refrigerant circuit, and the reversing valve comprises:

an inlet configured to receive the refrigerant from a compressor in the heating mode and in the cooling mode;

an outlet configured to direct the refrigerant from the reversing valve toward the compressor in the heating mode and in the cooling mode;

a reheat port configured to direct the refrigerant from the reversing valve toward the reheat heat exchanger in the heating mode and in the cooling mode;

a first heat exchanger port configured to receive the refrigerant from a first additional heat exchanger disposed along the refrigerant circuit in the cooling mode and configured to direct the refrigerant from the reversing valve toward the first additional heat exchanger in the heating mode; and a second heat exchanger port configured to direct the refrigerant from the reversing valve toward a second additional heat exchanger disposed along the refrigerant circuit in the heating mode and configured to receive the refrigerant from the second additional heat exchanger in the cooling mode.

10. The HVAC system of claim 9, wherein the reversing valve comprises a body and a slide disposed within the body, the slide is adjustable between a first position and a second position, the slide is configured to direct the refrigerant from the first heat exchanger port to the outlet in the first position to enable operation of the HVAC system in the cooling mode, and the slide is configured to direct the refrigerant from the second heat exchanger port to the outlet in the second position to enable operation of the HVAC system in the heating mode.

11. The HVAC system of claim 10, wherein the reversing valve is configured to direct the refrigerant from the inlet, through the body, and to the reheat port in the first position of the slide and in the second position of the slide.

12. The HVAC system of claim 9, wherein the outlet is disposed between the first heat exchanger port and the second heat exchanger port relative to a length of a body of the reversing valve.

13. The HVAC system of claim 9, wherein the inlet and the reheat port are disposed opposite the outlet relative to a body of the reversing valve.

14. A heat pump configured to operate in a heating mode and in a cooling mode, wherein the heat pump comprises:

a reheat heat exchanger configured to transfer heat from a refrigerant to an air flow supplied to a conditioned space in the heating mode and in the cooling mode;

a first heat exchanger disposed upstream of the reheat heat exchanger, relative to flow of the air flow through the heat pump, wherein the first heat exchanger is configured to transfer heat between the refrigerant and the air flow;

a second heat exchanger configured to transfer heat between the refrigerant and an ambient air flow; and a reversible valve comprising a first heat exchanger port fluidly coupled to the first heat exchanger, a second heat exchanger port fluidly coupled to the second heat exchanger; and a reheat port fluidly coupled to the reheat heat exchanger, wherein the reheat port is configured to discharge refrigerant from the reversible valve toward the reheat heat exchanger in the heating mode and in the cooling mode.

15. The heat pump of claim 14, wherein the reheat port is disposed opposite the first heat exchanger port and the second heat exchanger port relative to a body of the reversible valve.

16. The heat pump of claim 14, wherein the reversible valve comprises:

an inlet configured to receive the refrigerant from a compressor of the heat pump in the heating mode and in the cooling mode; and an outlet configured to direct the refrigerant from the reversing valve toward the compressor in the heating mode and in the cooling mode, wherein the inlet and the reheat port are disposed opposite the first heat exchanger port, the second heat exchanger port, and the outlet relative to a body of the reversible valve.

17. The heat pump of claim 16, wherein the outlet is disposed between the first heat exchanger port and the second heat exchanger port relative to a length of the body, the reversible valve comprises a slide disposed within the body, the slide is adjustable between a first position corresponding to the cooling mode and a second position corresponding to the heating mode, and wherein:

in the first position, the slide is configured to direct the refrigerant from the first heat exchanger port to the outlet, and in the second position, the slide is configured to direct the refrigerant from the second heat exchanger port to the outlet.

18. The heat pump of claim 14, comprising:

a valve associated with the reheat port, wherein the valve is configured to adjust an amount of the refrigerant directed from the reversible valve to the reheat heat exchanger via the reheat port; and a controller communicatively coupled to the valve, wherein the controller is configured to:

adjust the valve to control an amount of reheat provided by the reheat heat exchanger to the air flow in the cooling mode; and adjust the valve to control an amount of supplemental heating provided by the reheat heat exchanger to the air flow in the heating mode.

19. The HVAC system of claim 9, comprising a valve associated with the reheat port, wherein the valve is configured to adjust an amount of the refrigerant directed from the reversing valve toward the reheat heat exchanger via the reheat port.

20. The HVAC system of claim 19, comprising a controller communicatively coupled to the valve associated with the reheat port, wherein the controller is configured to adjust the valve to control an amount of reheat provided by the reheat heat exchanger to the air flow in the cooling mode, and the controller is configured adjust the valve to control an amount of supplemental heating provided by the reheat heat exchanger to the air flow in the heating mode.

* * * * *